US008196440B2

(12) United States Patent
Hosoito et al.

(10) Patent No.: US 8,196,440 B2
(45) Date of Patent: Jun. 12, 2012

(54) DRUM WASHING MACHINE

(75) Inventors: Tsuyoshi Hosoito, Aichi (JP); Yoji Okazaki, Tokyo (JP)

(73) Assignees: Kabushiki Kaisha Toshiba, Tokyo (JP); Toshiba Ha Products Co., Ltd., Osaka (JP); Toshiba Consumer Marketing Corporation, Tokyo (JP)

( * ) Notice: Subject to any disclaimer, the term of this patent is extended or adjusted under 35 U.S.C. 154(b) by 1302 days.

(21) Appl. No.: 10/528,791

(22) PCT Filed: Jun. 26, 2003

(86) PCT No.: PCT/JP03/08162

§ 371 (c)(1),
(2), (4) Date: Mar. 23, 2005

(87) PCT Pub. No.: WO2004/029350

PCT Pub. Date: Apr. 8, 2004

(65) Prior Publication Data

US 2006/0021392 A1 Feb. 2, 2006

(30) Foreign Application Priority Data

Sep. 24, 2002 (JP) ..... 2002-277325

(51) Int. Cl.
*D06F 37/00* (2006.01)
*D06F 33/00* (2006.01)

(52) U.S. Cl. ..... 68/12.04; 68/12.06; 68/3 R

(58) Field of Classification Search ..... 68/3 R, 68/12.06, 12.04; 8/159; 318/138, 254, 432, 318/439, 779

See application file for complete search history.

(56) References Cited

U.S. PATENT DOCUMENTS 4,607,408 A 8/1986 Didier et al.

(Continued)

FOREIGN PATENT DOCUMENTS

DE 198 57 903 A1 6/1999

(Continued)

OTHER PUBLICATIONS

European Search Report for Application No. EP 03 73 8535, dated Nov. 7, 2005.

(Continued)

*Primary Examiner* — Michael Kornakov
*Assistant Examiner* — Nicole Blan
(74) *Attorney, Agent, or Firm* — Pillsbury Winthrop Shaw Pittman, LLP

(57) ABSTRACT

The present invention is directed to a drum washing machine. In particular, the drum washing machine includes a rotating tub, wherein the rotating tub has a cylindrical drum having a front formed with a circular opening through which laundry is put into the rotating tub and having a rear that is closed. The drum washing machine further includes a DC brushless motor for generating a driving force for wash, rinse and dehydration operations and a rotor. The drum washing machine further includes a rotational shaft of the motor having a front end directly fixed to the rotating tub and a rear end fixed to a core of the rotor, so that torque developed by the motor is directly transmitted to the rotating tub. A current detector is provided in the drum washing machine for detecting electric current flowing into the motor. A torque control unit is also provided in the drum washing machine for performing a vector control for the motor on the basis of the current detected by the current detector, so that torque developed by the motor is rendered optimum for at least the wash and dehydration operations. A speed control unit for controlling a rotational speed of the motor, based on the current detected by the current detector and a laundry amount determining unit for determining an amount of laundry in the rotating tub, based on a magnitude of an accumulated value of torque current in a period when a rotational speed of the motor is accelerated are also provided in the drum washing machine of the present invention.

4 Claims, 8 Drawing Sheets

U.S. PATENT DOCUMENTS

| | | | | |
|---|---|---|---|---|
| 5,507,055 | A | 4/1996 | Blauert et al. | |
| 5,864,104 | A * | 1/1999 | Tawada et al. | 187/316 |
| 5,870,905 | A * | 2/1999 | Imamura et al. | 68/12.04 |
| 6,163,912 | A * | 12/2000 | Matsuura et al. | 8/159 |
| 6,307,759 | B1 * | 10/2001 | Inarida et al. | 363/37 |
| 6,842,928 | B2 * | 1/2005 | Yang et al. | 8/159 |
| 7,097,140 | B2 * | 8/2006 | Staley et al. | 244/165 |
| 2002/0046581 | A1 * | 4/2002 | Shimakage et al. | 68/12.04 |

FOREIGN PATENT DOCUMENTS

| | | | |
|---|---|---|---|
| EP | 0 159 202 | A1 | 10/1985 |
| EP | 0 657 575 | B1 | 6/1995 |
| EP | 0 780 506 | B1 | 6/1997 |
| EP | 1 094 145 | B1 | 4/2001 |
| GB | 2 332 212 | A | 6/1999 |
| JP | 9-253379 | | 9/1997 |
| JP | 09-253379 | A | 9/1997 |
| JP | 10-323492 | A | 8/1998 |
| JP | 10-323492 | | 12/1998 |
| JP | 11-319367 | A | 11/1999 |
| JP | 2000334194 | A * | 12/2000 |
| JP | 2001-178992 | | 7/2001 |
| JP | 2001-259281 | A | 9/2001 |
| JP | 2001-310097 | | 11/2001 |
| JP | 2002-126390 | | 5/2002 |
| JP | 2002-336593 | A | 11/2002 |
| JP | 2003-53092 | | 2/2003 |
| JP | 2004-49631 | | 2/2004 |

OTHER PUBLICATIONS

European Office Action for European Application No. 03 738 535. 8-2314 dated Oct. 13, 2009.

* cited by examiner

| DETECTED WEIGHT (kg) | Q-AXIS CURRENT INTEGRAL VALUE (A·S) |
|---|---|
| 0~LESS THAN 1 | 3~LESS THAN 4.5 |
| 1~LESS THAN 2 | 4.5~LESS THAN 6 |
| 2~LESS THAN 4 | 6~LESS THAN 9 |
| 4 OR ABOVE | 9 OR ABOVE~ |

FIG. 3

(a) SMALL UNBALANCED STATE

| LOAD (kg) | Q-AXIS CURRENT INTEGRAL VALUE QI (A·S) | Q-AXIS CURRENT VARIATION INTEGRAL VALUE QchI (A·S) | Q-AXIS CURRENT INTEGRAL VALUE Qc (A·S) AFTER COMPENSATION |
|---|---|---|---|
| 1.0 | 4.5 | 0.2 | 4.5 |
| 2.0 | 6.0 | 0.2 | 6.0 |
| 3.0 | 7.5 | 0.2 | 7.5 |
| 4.0 | 9.0 | 0.2 | 9.0 |
| 5.0 | 10.5 | 0.2 | 10.5 |

FIG. 4A (b) LARGE UNBALANCED STATE

| | | | |
|---|---|---|---|
| 1.0 | 6.0 | 0.5 | 4.615384615 |
| 2.0 | 7.5 | 0.5 | 5.769230769 |
| 3.0 | 9.5 | 0.5 | 7.307692308 |
| 4.0 | 12.5 | 0.7 | 8.333333333 |
| 5.0 | 17.0 | 0.8 | 10.625 |

FIG. 4B

| DETECTED WEIGHT (kg) | DISPLAYED DETERGENT AMOUNT |
|---|---|
| 0~LESS THAN 1 | 0.4 SPOONFUL |
| 1~LESS THAN 2 | 0.6 SPOONFUL |
| 2~LESS THAN 4 | 0.8 SPOONFUL |
| 4 OR ABOVE | 1.0 SPOONFUL |

DRUM WASHING MACHINE

CROSS REFERENCE TO RELATED APPLICATIONS

This is the U.S. National Stage of PCT/JP2003/008162, filed Jun. 26, 2003, which in turn claims priority to Japanese Patent Application No. 2002-277325, filed Sept. 24, 2002, both of which are incorporated herein by reference in their entireties.

FIELD OF THE INVENTION

This invention relates to a washing machine in which electric current is detected flowing into an electric motor generating driving force for wash, rinse and dehydration operations and a vector control is carried out for the motor.

BACKGROUND ART

JP-A-2002-126390 and JP-A-2001-178992 disclose conventional techniques for detecting a weight of laundry put into a rotating tub of a washing machine, for example. In the disclosed techniques, a rotation sensor is mounted on an electric motor to detect a rise time required for the rotational speed of the motor to change from a first rotational speed to a second rotational speed while a predetermined power is being supplied to the motor. A weight of laundry is detected according to the detected rise time.

However, the above-described conventional techniques have the following problems. Firstly, in order that the predetermined power may be supplied to the motor, motor voltage is controlled to be held constant. However, output differs upon load variations even under the condition where motor voltage is constant. As a result, an accurate detection cannot be carried out.

Secondly, the above-described detection is equivalent to detecting acceleration of the motor and requires a long period of time equal to the aforesaid rise time. Furthermore, the foregoing first reason tends to increase variations in the results of detection. Accordingly, rise time detection needs to be carried out at a plurality of times. Thus, a long time is required for the rise time detection.

The present invention was made in view of the foregoing and an object of the present invention is to provide a washing machine in which the weight of laundry can be detected quickly and accurately.

DISCLOSURE OF THE INVENTION

The present invention provides a drum washing machine comprising a rotating tub comprised of a cylindrical drum having a front formed with a circular opening through which laundry is put into the rotating tub and a rear closed, a DC brushless motor generating a driving force for wash, rinse and dehydration operations and having a rotational shaft directly connected to the rotating tub, a current detector detecting electric current flowing into the motor, a torque control unit performing a vector control for the motor on the basis of the current detected by the current detector so that torque developed by the motor is rendered optimum for at least the wash and dehydration operations, a speed control unit controlling a rotational speed of the motor based on the current detected by the current detector, and a laundry amount determining unit determining an amount of laundry in a rotating tub, based on a magnitude of an accumulated value of torque current in a period when a rotational speed of the motor is accelerated.

Under the condition where the rotational speed of the motor is constant, variations in the motor output torque are small even when an amount of laundry in the rotating tub differs. The output torque varies to a large extent according to an amount of laundry in the rotating tub while the rotational speed of the motor is changing. A q-axis (quadrature axis) current obtained when a vector control is carried out for an electric motor is a current proportional to output torque of the motor, that is, a torque current. Consequently, an amount of laundry can be determined more accurately when the laundry amount determining unit determines an amount of laundry in the manner as described above. Furthermore, the detecting time can be reduced since the q-axis current value in a predetermined period is merely referred to.

The laundry amount determining unit preferably determines an amount of laundry, based on the magnitude of torque current in a period when the motor is accelerated. More specifically, since the operational control in the washing machine is directed mainly to control for acceleration, an amount of laundry can easily be determined during the accelerating period.

The washing machine preferably comprises a temperature detector detecting a temperature of the motor or an atmospheric temperature around the motor. In this construction, the laundry amount determining unit compensates a result of determination of laundry amount, based on the temperature detected by the temperature detector. More specifically, in the rotating mechanism section, a mechanical frictional force varies according to the viscosity of a lubricant further varying according to an atmospheric temperature. Consequently, accuracy in the detection can be improved when the result of determination is compensated on the basis of the temperature detected by the temperature detector.

Furthermore, the washing machine preferably further comprises an unbalance detector detecting an unbalanced state of laundry in the rotating tub, based on the torque current, wherein the laundry amount determining unit compensates a result of determination of laundry amount, based on the unbalanced state detected by the unbalance detector. The motor is excessively loaded when laundry is unbalanced in the rotating tub, for example. In this case, an amount of laundry detected becomes larger than an actual amount. Accordingly, when compensation is made so that the result of detection is rendered smaller, the accuracy in the detection can be improved.

BRIEF DESCRIPTION OF THE DRAWINGS

FIG. 3 is a table used to detect the weight of laundry according to a compensation integral value Qc;

FIGS. 4A and 4B show examples of values compensated by equation (1) in the cases where an unbalanced state of laundry is small and large, respectively;

BEST MODE FOR CARRYING OUT THE INVENTION

Figure 8:
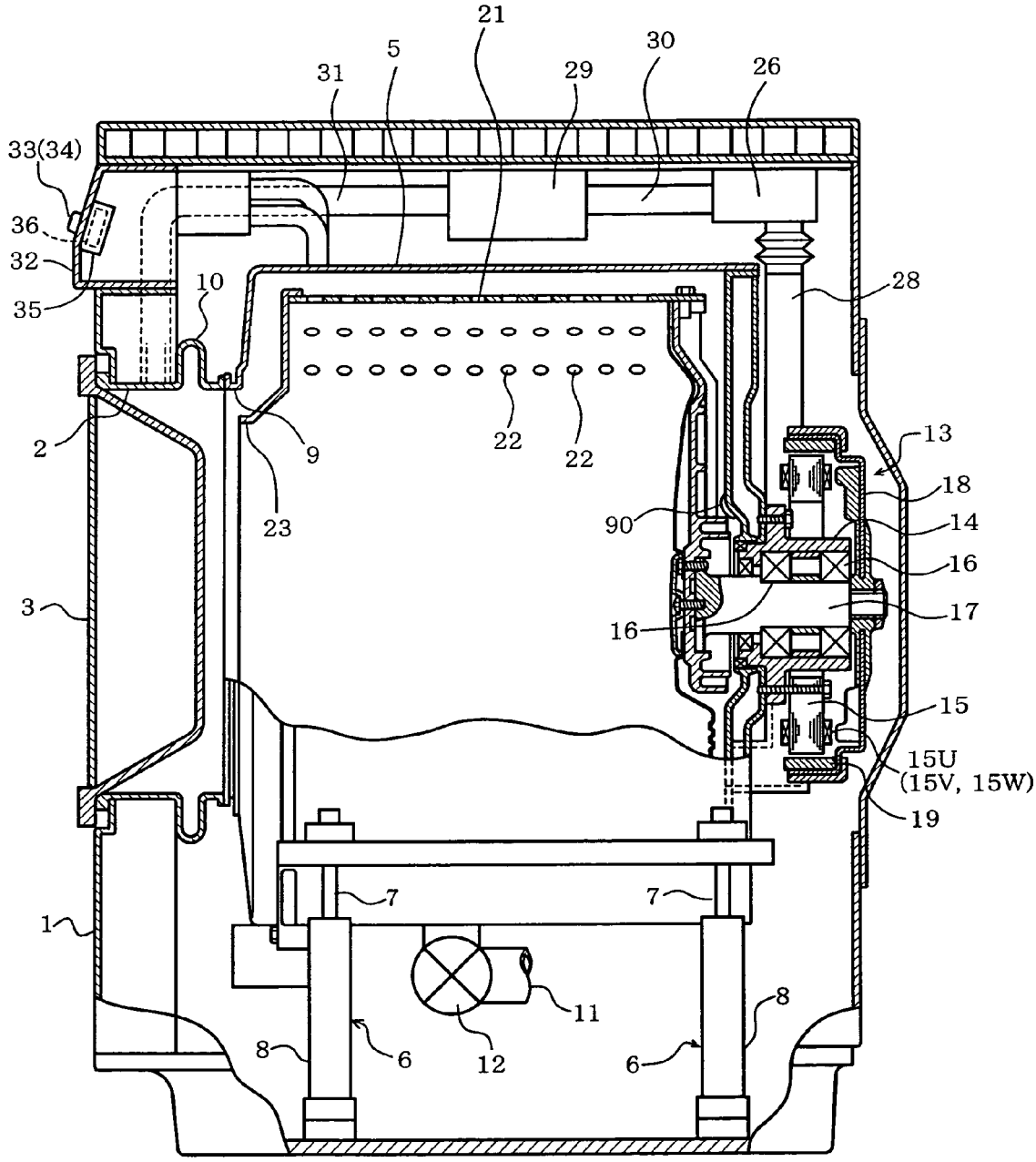
FIG. 8 is a longitudinal side section of the drum type washing machine.
Figure 9:
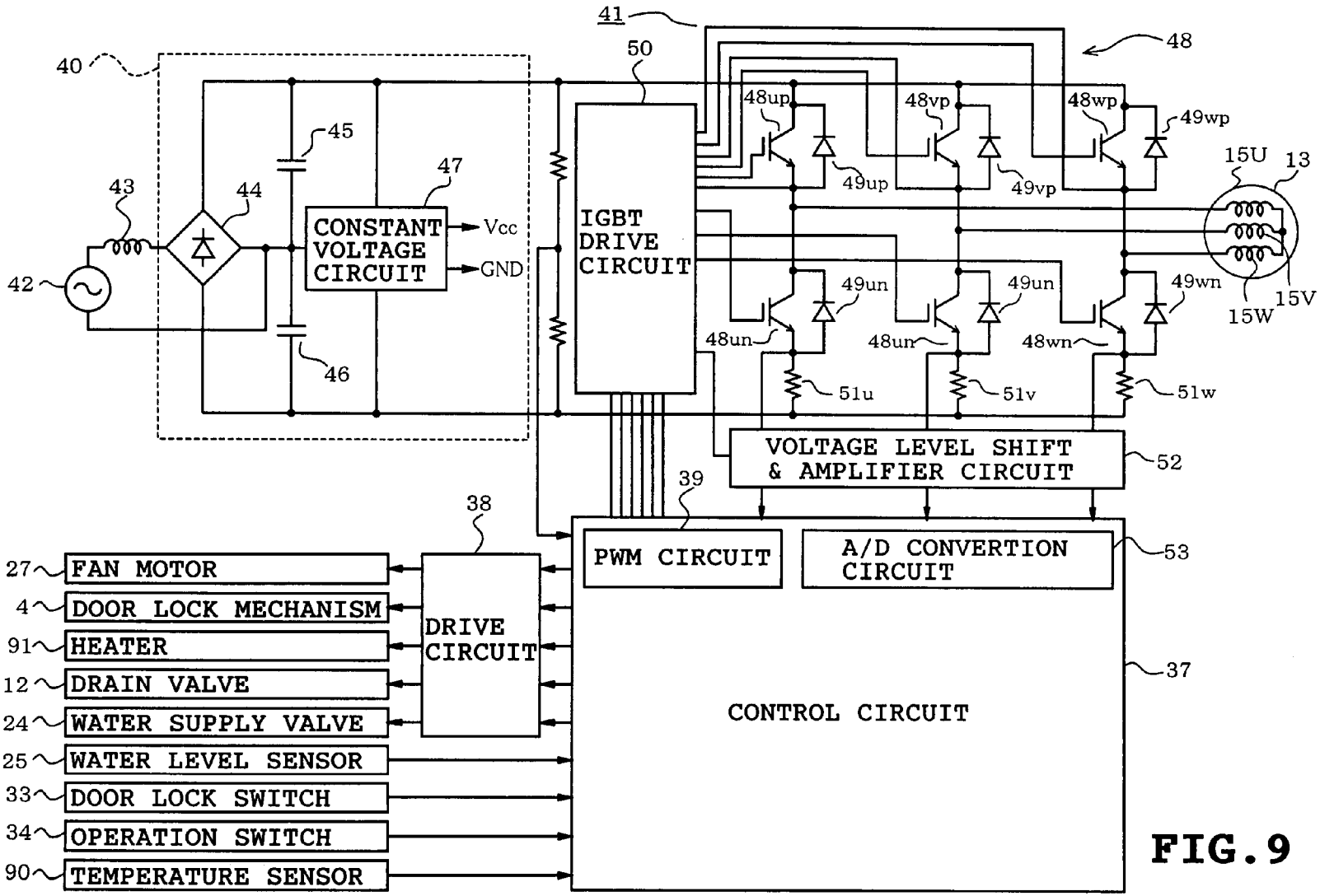
FIG. 9 is a circuit diagram showing an electrical arrangement of the washing machine.

One embodiment of the present invention will be described with reference to the accompanying drawings. Referring first to FIG. 8, a drum type washing machine in accordance with the invention is shown. The washing machine comprises a cabinet 1 formed by assembling steel plates into the shape of a rectangular box. The cabinet 1 includes a front formed with a circular opening 2. A circular door 3 is mounted on the front of the cabinet 1 so as to be caused to pivot so that the opening 2 is closed and opened. A door lock mechanism 4 (see FIG. 9) is provided on the cabinet 1 and includes an electromagnetic solenoid (not shown) serving as a drive source. When the electromagnetic solenoid is excited during closure of the door 3, a plunger of the solenoid is moved to a lock position thereby to hold the door in a closed state.

A generally circular cylindrical water-receiving tub 5 is provided in the cabinet 1. The water-receiving tub 5 has a closed rear and is connected to rods 7 of a plurality of shock absorbers 6. The shock absorbers 6 include respective cylinders 8 fixed to a bottom plate of the cabinet 1. Thus, the water-receiving tub 5 is elastically supported by the shock absorbers 6 so that an axis thereof is horizontal. The water-receiving tub 5 has a circular opening 9. Bellows 10 are interposed between peripheral edges of the openings 9 and 2. The bellows 10 are circular cylindrical in shape and provides watertightness between the openings 9 and 2.

A generally circular cylindrical drain 11 is fixed to a lowermost portion of the water-receiving tub 5. The drain 11 includes an upper end communicating with the water-receiving tub 5 and a lower end communicating with the outside of the cabinet 1. An electromagnetic drain valve 12 is mounted inside the drain 11 so that the drain is opened and closed when the state of the drain valve is switched. A three-phase brushless DC motor of the outer rotor type is employed as a washing machine motor 13, for example. The motor 13 is mounted in the cabinet 1. A cylindrical bracket 14 is fixed to the rear of the water-receiving tub 5. The motor 13 includes a stator core 15 fixed to the outer periphery of the bracket 14. The stator core 15 has thirty-six teeth including twelve teeth on which a phase U coil 15*u* is wound. The thirty-six teeth include other twelve teeth on which a phase V coil 15*v* is wound. A phase W coil 15*w* is wound on the remaining twelve teeth (see FIG. 9).

Two bearings 16 are mounted on an inner peripheral face of the bracket 14. A rotational shaft 17 is supported on inner peripheral faces of the bearings 16. The rotational shaft 17 is co-axial with the water-receiving tub 5 and has a front end inserted into the interior of the water-receiving tub. A circular cylindrical rotor core 18 has a closed rear and is fixed to a rear end of the rotational shaft 17. Twenty-four rotor magnets 19 are fixed to an inner peripheral face of the rotor core 18.

A drum or rotating tub 21 is provided in the water-receiving tub 5 and is fixed to the rotational shaft 17 of the motor 13. The drum 21 is generally circular cylindrical in shape and has a closed rear. The drum 21 is disposed in a horizontal state so as to be co-axial with the water-receiving tub 5. The drum 21 has a plurality of dehydration holes 22 formed in the overall peripheral part thereof. The drum 21 has a circular opening 23 formed in the front thereof. The opening 23 is positioned in the rear of the opening 9 of the water-receiving tub 5 so as to be opposed to the opening 9. When the door 3 is open, laundry (not shown) is put through the openings 9 and 23 into the drum 21.

A temperature sensor (temperature sensing unit) 90 comprises a thermistor, for example and is disposed on the inner face of the water-receiving tub 5 so as to be opposite the rear of the drum 21 and so as to be located near the rotational shaft 17 of the motor 13. The temperature sensor 90 detects an atmospheric temperature near the rotating mechanism including the motor 13. A sensor signal generated by the temperature sensor 90 is delivered to a control circuit 37.

An electromagnetic water-supply valve 24 (see FIG. 9) is fixed to an upper end of the inner wall of the cabinet 1. The water-supply valve 24 has an input port, water-supply output port and dehumidifying output port. The input port of the water-supply valve 24 is connected via a water-supply hose (not shown) to a faucet of water service. The water-supply output port of the water-supply valve 24 communicates with the interior of the water-receiving tub 5. Water from the water service is supplied via the faucet and water-supply valve 24 into the water-receiving tub 5 to be reserved when the water-supply output port is opened while the drain valve 12 is closed.

A water level sensor 25 (see FIG. 9) is provided in the cabinet 1. The water level sensor 25 comprises a circular cylindrical coil and an electrically conductive pole slidably inserted into an inner circumference of the coil. The pole is slid according to a water level in the water-receiving tub 5, whereupon its amount of axial overlap relative to the coil is changed, whereby a water level signal with frequency according to an amount of overlap is delivered.

A fan casing 26 is located at and fixed to the rear end of a ceiling plate. The fan casing 26 has an outlet in a front face and an inlet in a rear face thereof and is formed into a spiral shape. A fan (not shown) is provided in the fan casing 26 so as to be rotatable. A fan motor (see FIG. 9) is fixed to a ceiling plate of the cabinet 1. A capacitor-start induction motor is employed as the fan motor and has a rotational shaft coupled via a belt transmission mechanism (not shown) to the rotational shaft of the fan.

A longitudinally long dehumidifying duct 28 is fixed to the rear face of the water-receiving tub 5. The dehumidifying duct 28 has a lower end communicating with the interior of the water-receiving tub 5 and an upper end connected to the inlet of the fan casing 26, whereupon air in the water-receiving tub 5 is sucked via the dehumidifying duct 28 into the fan casing 26 during rotation of the fan. A heater case 29 is fixed to the ceiling of the cabinet 1 so as to be located in front of the fan casing 26. A junction duct 30 has a front end connected to the rear of the heater case 29 and a rear end connected to the outlet of the fan casing 26, whereupon air sucked into the fan casing 26 flows through the junction duct 30 into the heater case 29. A heater 91 (see FIG. 9) is enclosed in the heat case 29. Accordingly, air flowing into the heater case 29 is heated by the heater 91 to be produced into hot air.

A hot air duct 31 has an end connected to the front of the heater case 29. The hot air duct 31 has the other end extending through the bellows 10, communicating with the interior of the water-receiving tub 5. As a result, hot air produced in the heater case 29 is discharged through the hot air duct 31 into the water-receiving tub 5 and drum 21. Furthermore, a dehumidifying hose (not shown) has one end connected to a dehumidifying output port of the water-supply valve 24. The dehumidifying hose has the other end communicating with the upper end of the interior of the dehumidifying duct 28. Water from the water service is supplied into the dehumidifying duct 28 when the dehumidifying output port is opened.

An operation panel 32 is fixed to the front of the cabinet 1 and includes a door lock switch 33 (see FIG. 9) and an operation switch 34 provided on a front thereof. Furthermore, a circuit box 35 is provided on a rear of the operation panel 32. A circuit board 36 is enclosed in the circuit box 35. A control circuit 37 is mounted on the circuit board 36 and serves as a current detector, torque control unit, speed control unit, laundry amount determining unit, temperature detector and unbalance detector. The control circuit 37 mainly comprises a microcomputer and has input terminals to which a rotation sensor 20, water level sensor 25, door lock switch 33 and operation switch 34 are electrically connected respectively. The control circuit 37 further has output terminals to which the door lock mechanism 4, drain valve 12, water-supply valve 24, fan motor 27 and heater 91 are electrically connected via drive circuits respectively. When detecting operation of the door lock switch 33, the control circuit 33 drives the door lock mechanism 4 to lock the door 3 in the closed state.

A control program for generation of PWM signals is recorded on an internal ROM of a control circuit 37. The control circuit 37 processes rotation signals Hu and Hv from the rotation sensor 20, based on the control program, thereby generating substantially sinusoidal energization signals Du, Dv and Dw. The energization signals Du, Dv and Dw define a drive timing for and voltage applied to each of phase U coils 15*u* to 15*w* and are delivered to a PWM circuit 39. Regarding the energization signal Dw of phase W coil 15*w*, phase W rotation signal Hw is calculated on the basis of the rotation signals Hu and Hv. The energization signal Dw is set on the basis of the results of calculation.

The PWM circuit 39 constitutes a part of the control circuit 37 and includes a triangular wave generator and a comparator neither of which is shown. The triangular wave generator generates a triangular wave signal with a predetermined frequency. The comparator compares the triangular wave signal with each of the energization signals Du to Dw, thereby generating drive signals Vup to Vwn (PWM signals).

A power supply circuit 40 and a motor drive circuit 41 are mounted on a circuit board 36. A commercial AC power supply 42 has one output terminal to which one input terminal of a rectifier circuit 44 is connected via a reactor 43. The other input terminal of the rectifier circuit 44 is connected to the other output terminal of the AC power supply 42. The rectifier circuit 44 has both output terminals between which a series circuit of two capacitors 45 and 46 is connected. A common node of the capacitors 45 and 46 is connected to said one output terminal of the AC power supply 42. The upper capacitor 45 is charged with positive rectified output, whereas the lower capacitor 46 is charged with negative rectified output.

A constant voltage circuit 47 is connected between both output terminals of the rectifier circuit 44. The constant voltage circuit 47 is mainly composed of a switching regulator and reduces voltage of a high-voltage DC power supply generated by the capacitors 45 and 46, thereby generating a low-voltage DC power supply Vcc for driving the control circuit 37 and the like.

An inverter circuit 48 is connected between both output terminals of the rectifier circuit 44. The inverter circuit 48 comprises IGBT's (insulated-gate bipolar transistors) 48*up* to 48*wn* connected into a three-phase bridge configuration. Phase U to W coils 15*u* to 15*w* of the washing machine motor 13 are connected to phase U to W output terminals of the inverter circuit 48 respectively. Reference numeral 49 designates a free wheel diode connected between collectors and emitters of the IGBT's 48*up* to 48*wn* respectively. The IGBT's 48*up* to 48*wn* have respective gates connected to an IGBT drive circuit 50. The IGBT drive circuit 50 is mainly composed of a photocoupler and generates gate drive signals for the IGBT's 48*up* to 48*wn*, based on drive signals Vup to Vwn from the PWM circuit 39 respectively.

The lower arm side IGBT's 48*up* to 48*wn* have emitters grounded via current detecting shunt resistors (current detecting means) 51*u* to 51*w* respectively. Common nodes of the emitters and shunt resistors are connected via a voltage level shift and amplifier circuit 52 to input ports of an A/D conversion circuit (current detecting means) provided in the control circuit 37. Each shunt resistor is set for a resistance value of about 0.1 Ω. The voltage level shift and amplifier circuit 52 includes an operational amplifier, and amplifies a terminal voltage of each shunt resistor and biases the amplified signal so that an output range of the signal is at the positive side (for example, 0 to +5 V). The control circuit 37 carries out a vector control for output torque of the motor 13 in a sensorless control system, based on phase currents detected by the shunt resistors 51*u* to 51*w* respectively. The control circuit 37 further carries out a PI control for the rotational speed of the motor 13. Japanese Patent Application No. 2002-27691 discloses the above-mentioned vector control and PI control in detail.

The vector control and PI control will be outlined as follows. In the following description, the coordinate, (α, β) designates a rectangular coordinate system obtained by orthogonal transformation of a three-phase coordinate system at intervals of 120 degrees by electrical angle regarding respective phases of the three-phase brushless motor 13. The coordinate, (d, q) designates a coordinate system of secondary flux in rotation with rotation of a rotor of the motor 13.

The PI control section carries out a PI control, based on a difference between a target speed command $\omega_{ref}$ and detected speed ω of motor 13, thereby generating a q-axis current command value $I_{qref}$ and a d-axis current command value $I_{dref}$. The d-axis current command value $I_{dref}$ is set for 0 in a wash or rinse operation. The d-axis current command value $I_{dref}$ is set for a predetermined value for a weak magnetic field control in a dehydration operation.

A current PI control section carries out PI control based on the results of subtraction of a q-axis current value Iq and a d-axis current value Id delivered by an αβ/dq conversion section from the d-axis current command value $I_{dref}$ and q-axis current command value $I_{qref}$ respectively, thereby generating a q-axis voltage command value Vq and a d-axis voltage command value Vd. The αβ/dq conversion section is supplied with a rotation phase angle (rotor position angle) θ of second magnetic field of the motor 13 detected by an estimator (not shown). The αβ/dq conversion section converts the voltage command values Vd and Vq to voltage command values Vα and Vβ, based on the rotation phase angle θ. The αβ/UVW conversion section further converts the voltage command values Vα and Vβ to three-phase voltage command values Vu, Vv and Vw. A PWM forming section is supplied with either the voltage command values Vu, Vv and Vw or a starting voltage command value delivered by an initial pattern output section, by means of switching.

Each phase current detected by the shunt resistor is converted by the A/D conversion section 53. A UVW/αβ conversion section converts three-phase current data Iu, Iv and Iw to biaxial current data Iα and Iβ of the orthogonal coordinate system. When obtaining a rotor position angle θ of the motor 13 from the estimator during the vector control, the αβ/dq conversion section converts the biaxial current data Iα and Iβ to a d-axis current value Id and a q-axis current value Iq on a rotational coordinate system (d, q). The UVW/αβ conversion section delivers the d-axis current value Id and q-axis current value Iq to the estimator and the like as described above. The estimator estimates the rotor position angle θ and rotational speed ω, based on the d-axis and q-axis current values Id and Iq, delivering the estimated values to the sections.

Figure 1:
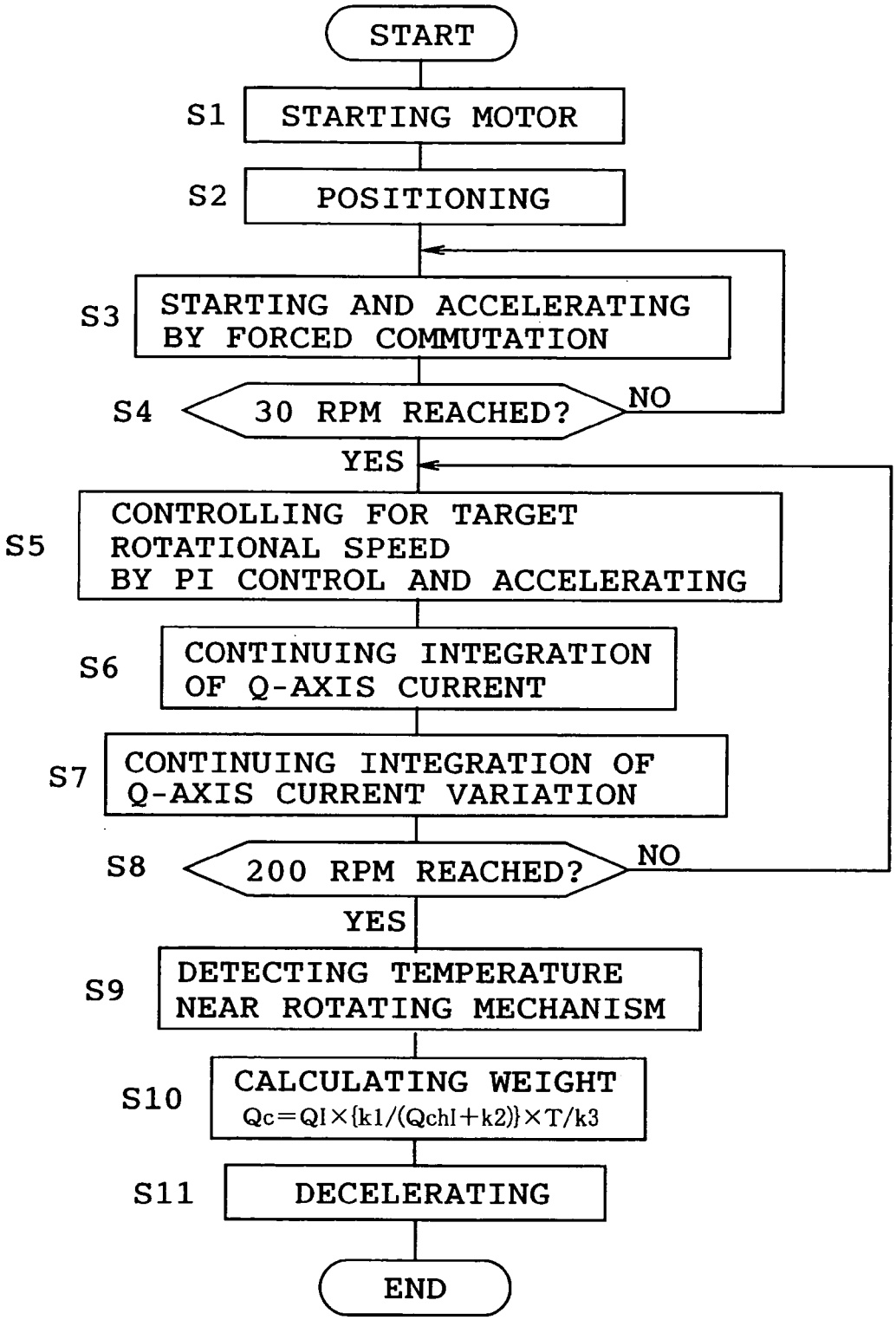
FIG. 1 is a flowchart showing control contents for detection of an amount of laundry put into a drum in a washing machine of an embodiment in accordance with the present invention.
Figures 2A, 2B:
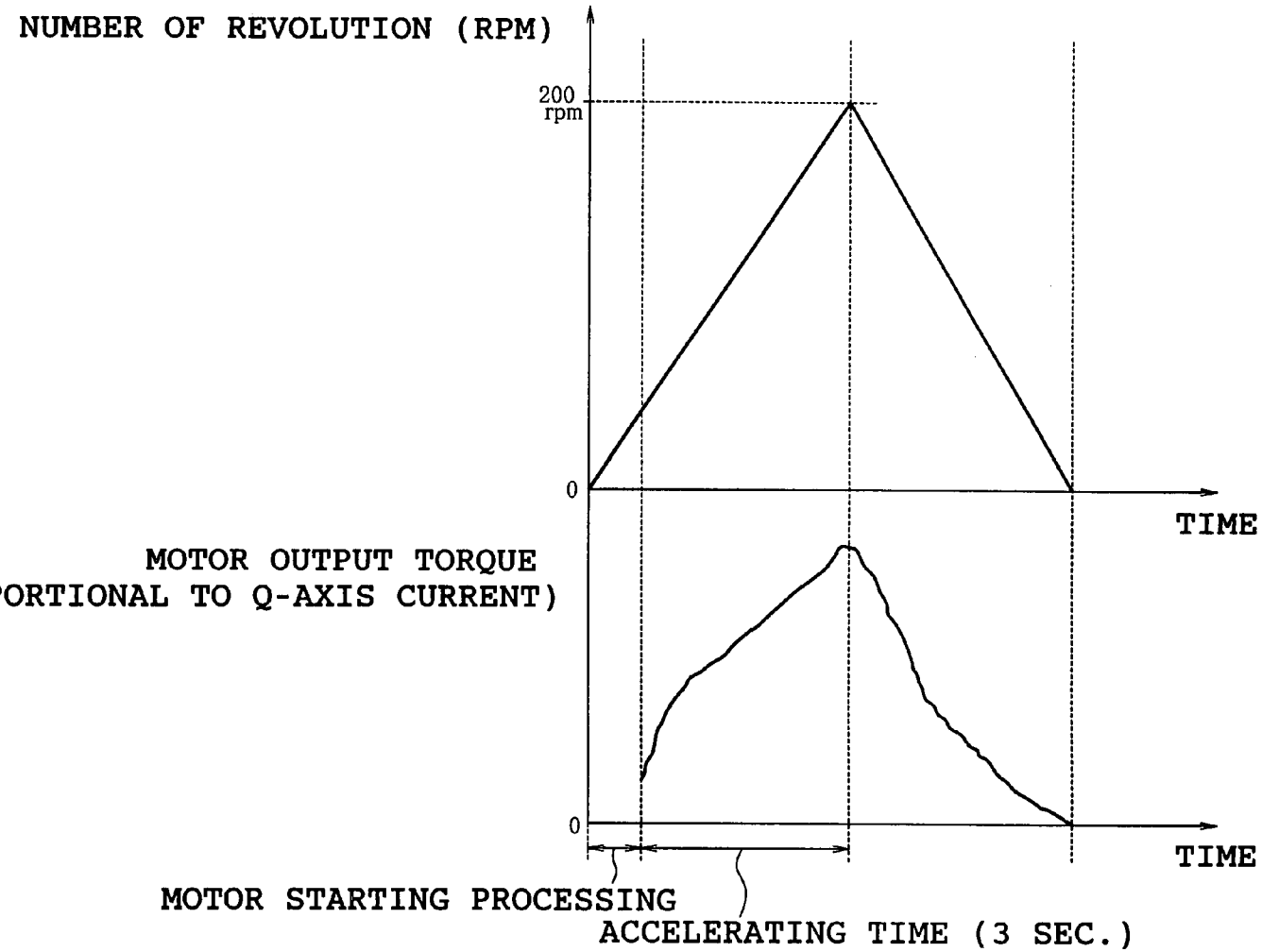
FIGS. 2A and 2B show a driving pattern of the washing machine motor in the case where the control as shown in FIG. 1 is carried out, and changes in the output torque of the washing machine motor, respectively.

The above-described washing machine operates as follows. FIG. 1 is a flowchart showing control contents for detection of an amount of laundry put into the drum 21. FIG. 2A shows a driving pattern of the washing machine motor 13 in the case of FIG. 1. FIG. 2B shows an example of changes in the output torque of the washing machine motor 13.

When starting the drive control of the motor 13 (step S1), the control circuit 37 firstly positions the rotor by DC energization (step S2). A forced commutation is carried out by a starting voltage command delivered by an initial pattern output section as described above, so that the motor 13 starts (step S3). The control circuit 37 continues the force commutation at step S3 until the rotational speed of the motor 13 reaches 30 rpm at step S4. The control circuit 37 does not initiate a weight detection processing during execution of the forced commutation.

When the rotational speed of the motor 13 reaches 30 rpm (YES at step S4), the control circuit 37 switches the control to the vector control side. The rotational speed of the motor 13 is accelerated so as to reach a target speed (for example, 200 rpm) in about 3 sec. by the speed PI control (step S5; and see FIG. 2A). In this case, output torque of the motor 3 is increased in proportion to increase in the rotational speed as shown in FIG. 2B. However, a manner of torque increase differs depending on the weight of laundry in the drum 21. The output torque is substantially proportional to the q-axis current value Iq obtained in the vector control.

The control circuit 37 then samples and integrates (accumulates) the q-axis current value Iq at predetermined intervals for the acceleration period of about 3 seconds (step S6). More specifically, the output torque of the motor 13 changes according to the weight of laundry (load) under the condition where the rotational speed of the drum 21 is changing. Accordingly, when the values of q-axis current (corresponding to output torque) in this period are integrated, the weight of laundry can be estimated.

Furthermore, the control circuit 37 continues to integrate the q-axis current values Iq and also integrates variations of q-axis current (step S7). A degree of bias in the distribution of laundry in the drum 21 or an unbalanced state can be found when the variations of the q-axis current are referred to. As a result, the result of estimation regarding an amount of laundry can be compensated according to the unbalanced state. In other words, the rotational speed of the motor 13 is reduced to a large degree when the unbalanced state is excessive. An amount of laundry detected under this condition is assumed to become larger than the one detected in a normal condition. Accordingly, the control circuit 37 compensates so that the result of detection is rendered smaller in such a case.

Japanese Patent Application No. 2002-212788 discloses a system of detecting an unbalanced state of laundry in the drum on the basis of variations in the q-axis current. The system is applied here. That is, the q-axis current value sampled at step S6 is thinned out as occasion demands, so that each sample value squared is regarded as the variation in the q-axis current. The result of operation is integrated at step S7.

At step S8, the control circuit 37 determines whether the rotational speed of the motor 13 has reached a target speed, 200 rpm. When the rotational speed has not reached the target speed (NO at step S8), the control circuit 37 returns to step S5. When the rotational speed has reached the target speed (YES at step S8), the control circuit 37 detects a temperature T near the rotating mechanism, referring to a sensor signal delivered by the temperature sensor 90 (step S9). More specifically, a mechanical frictional force of the motor 13 varies when the viscosity of a lubricant supplied into a rotating mechanism such as a bearing changes according to the temperature T. Accordingly, compensation is conducted in the following manner since the loaded condition of the motor 13 changes slightly.

The control circuit 37 then calculates and estimates the weight of laundry. The integrated value Qc compensated by the unbalanced state of laundry and the temperature T (° C.) near the rotating mechanism is calculated as:

$$Qc=Q1\times\{k1/(QchI+k2)\}\times T/k3 \quad (1)$$

where Q1 is the q-axis current value integrated at step S6, QchI is a varying value of the q-axis current integrated at step S7, and k1, k2 and k3 are constants. The weight of laundry is estimated according to the compensated integrated value Qc as shown in FIG. 3.

Thereafter, the control circuit 37 reduces the rotational speed of the motor 13 and stops it, finishing the processing (step S11).

FIG. 4 shows a concrete numeric example of compensation with use of equation (1) regarding case (a) where the unbalanced state of laundry is small and case (b) where the unbalanced state of laundry is large. However, constant k1=1.0, constant k2=0.8, and compensation on the basis of temperature T is excluded. For example, in a case where the weight of laundry (load weight) is 3 kg, the q-axis current integral value QI is 7.5 A·S when the unbalanced state is small. When the unbalanced state is large, the q-axis current integral value QI is 9.5 A·S, which is larger than that when the unbalanced state is small. However, the q-axis current variation integral value QchI is 0.2 A·S accordingly when the unbalanced state is small (the former case). When the unbalanced state is large (the latter case), the q-axis current variation integral value QchI is 0.5 A·S accordingly. As a result, the compensated integral value Qc, which is the result of calculation with use of equation (1), is 7.5 A·S in the former case and 7.307 A·S. Thus, the integral values are compensated so as to approximate to each other.

Figure 5:
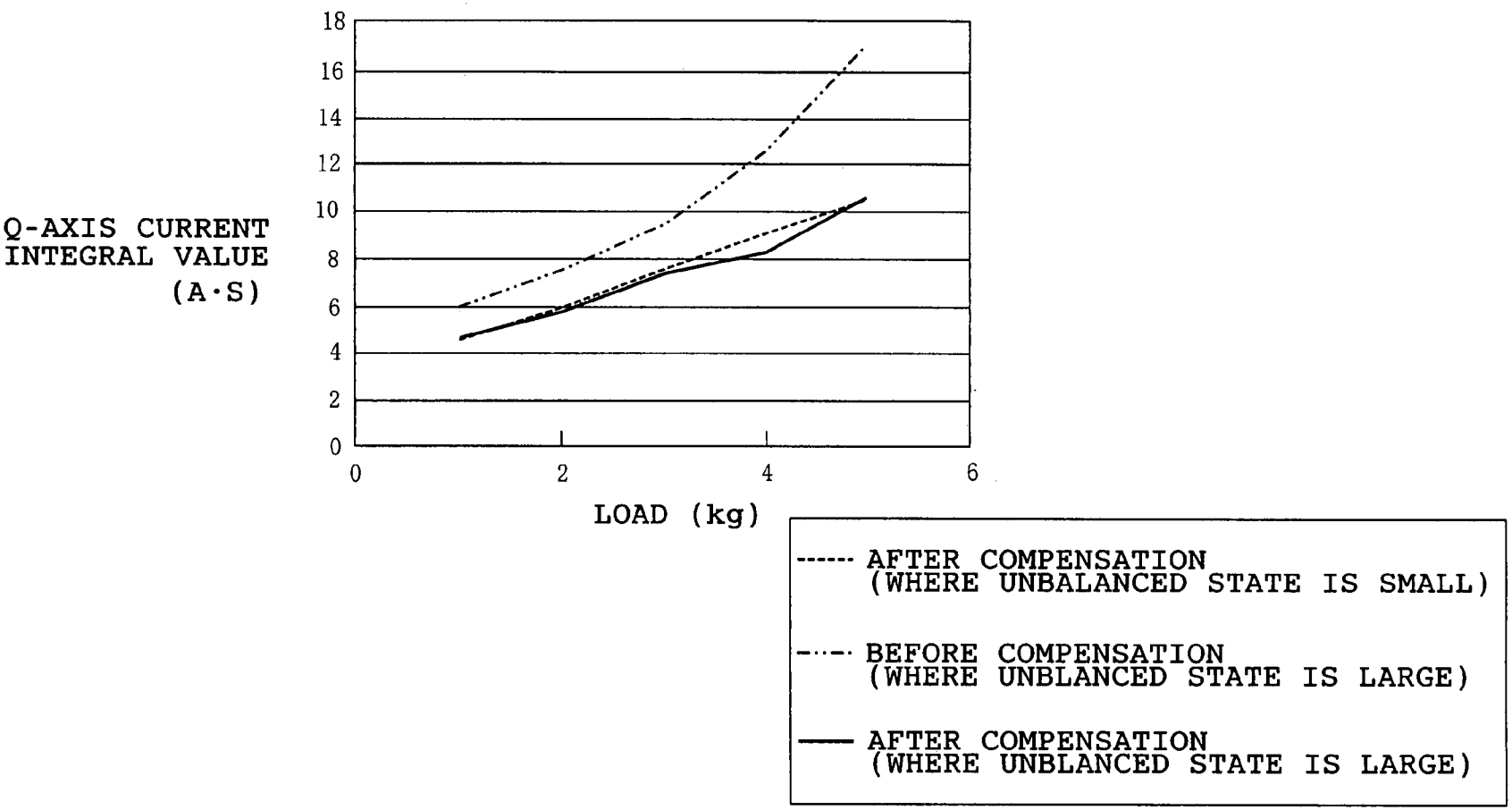
FIG. 5 is a graph showing values before compensation in the case where the unbalanced state is large and after compensation in the cases where the unbalanced state is large and small, respectively, where the axis of abscissas denotes the load weight and the axis of ordinates denotes q-axis current integral value.

In FIG. 5, the axis of abscissas denotes load weight and the axis of ordinates denotes q-axis current integral value. The graph shows the values before compensation when the unbalanced state is large, the values after compensation when the unbalanced state is large and small. In the example of FIG. 4, the values before compensation agree with those after compensation when the unbalanced state is small. Thus, it is understood that the values are compensated so as to be equal to each other even when the unbalanced state is sometimes small or large.

Figures 6, 7:
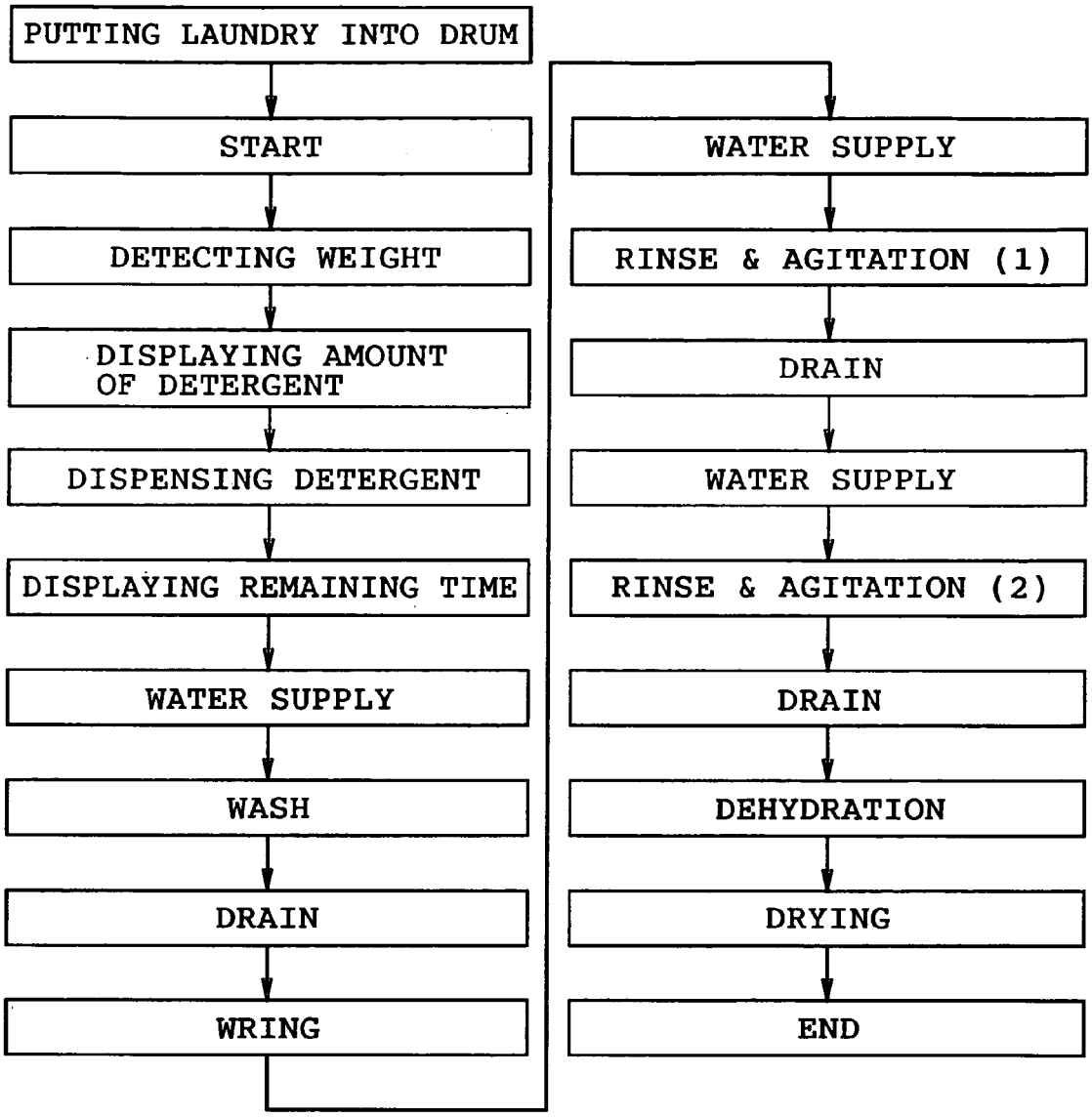
FIG. 6 is a flowchart showing all the operation steps of the washing machine.
FIG. 7 is a table of an amount of detergent according to the weight detected by the control circuit.

FIG. 6 shows all the steps of the washing machine. More specifically, the above-described weight detection is carried out when laundry such as clothes has been put into the drum 21 and a suitable washing course has been selected and started. The control circuit 37 displays, on a display (not shown), a necessary amount of detergent according to the detected weight (see FIG. 7). When the displayed amount of detergent has been dispensed, a time period required for completion of the remaining steps is displayed. A wash step including water supply, wash, draining and wringing is then executed. Successively, a rinse step is carried out. In the rinse step, a pattern including water supply, rinse and agitation and draining is carried out twice. Thereafter, a dehydration step and drying step are carried out, whereupon all the steps are completed.

In the above-described embodiment, the control circuit 37 executes the vector control for the control of output torque of the washing machine motor 13 and the PI control for the control of the rotational speed of the motor. The control circuit 37 thus determines the weight of laundry in the rotating tub, based on the magnitude of torque current in the period when the rotational speed of the motor 13 is changing. More specifically, the output torque changes to a large degree according to an amount of laundry in the drum 21 under the condition where the rotational speed of the motor 13 is changing. The q-axis current obtained by the vector control of the motor 13 is a current proportional to output torque of the motor, that is, a torque current. Accordingly, the weight of laundry in the drum 21 can be determined more accurately. Furthermore, the detection can be carried out in a shorter period of time than in the prior art since a mere requirement is referring to the q-axis current value in a predetermined period.

In this case, the control circuit 37 determines an amount of laundry, based on the magnitude of torque current in a period when the motor 13 is being accelerated. Accordingly, an amount of laundry can readily be determined in the period of acceleration which is mainly carried out in the control of the washing machine.

Furthermore, the control circuit 37 compensates the results of detection of laundry amount, based on the temperature detected by the temperature sensor 90. Accordingly, the accuracy in the detection can be improved since the compensation is executed in consideration of a frictional force of the rotating mechanism changing depending on the temperature.

The control circuit 37 further compensates the results of detection of the laundry weight, based on the variations in the q-axis current and the unbalanced state of laundry in the drum 21. Consequently, the detection accuracy can further be improved since an amount of load of the motor 13 is taken into consideration.

Several modified forms will be described. In the foregoing embodiment, the detection is carried out while the motor 13 is being accelerated. However, the detection may be carried out while the motor is being decelerated.

The compensation is carried out according to the unbalanced state and the temperature near the rotating mechanism. However, the compensation may or may not be carried out.

When it is determined that the unbalanced state of laundry is excessively large, at the time of start of weight detection, for example, when the variation of q-axis current exceeds a set upper limit when the motor speed reaches 100 rpm, the detection may be interrupted and it may be determined that maximum capacity is obtained.

The temperature detector may be disposed so as to detect the temperature of the motor or near the motor. Additionally, the invention may be applied to automatic washing machines of the vertical axis type in which agitating blades are rotated in the washing operation.

Industiral Applicability

According to the washing machine of the invention, an amount of laundry in the tub can be determined more accurately. Furthermore, an amount of laundry can be detected in a shorter time than in the prior art.

The invention claimed is:

1. A drum washing machine comprising:

a rotating tub comprised of a cylindrical drum having a front formed with a circular opening through which laundry is put into the rotating tub and a rear closed;

a DC brushless motor configured to generate a driving force for wash, rinse and dehydration operations and including a rotor;

a rotational shaft of the motor having a front end directly fixed to the rotating tub and a rear end fixed to a core of the rotor so that torque developed by the motor is directly transmitted to the rotating tub;

a current detector configured to detect electric current flowing into the motor;

a torque control unit configured to perform a vector control for the motor on the basis of the current detected by the current detector so that torque developed by the motor is rendered optimum for at least the wash and dehydration operations;

a speed control unit configured to control a rotational speed of the motor, based on the current detected by the current detector; and a laundry amount determining unit configured to determine an amount of laundry in the rotating tub, based on a magnitude of an accumulated value of torque current in a period when a rotational speed of the motor is accelerated, wherein an amount of detergent to be necessitated according to the determined amount of laundry is displayed on a display.

2. A washing machine according to claim 1, further comprising:

a temperature detector configured to detect a temperature of the electric motor or an atmospheric temperature around the electric motor, wherein the laundry amount determining unit compensates a result of determination of laundry amount, based on the temperature detected by the temperature detector.

3. A washing machine according to claim 2, further comprising:

an unbalance detector configured to detect an unbalanced state of laundry in the rotating tub, based on the torque current, wherein the laundry amount determining unit compensates a result of determination of laundry amount, based on the unbalanced state detected by the unbalance detector.

4. A washing machine according to claim 1, further comprising:

an unbalance detector configured to detect an unbalanced state of laundry in the rotating tub, based on the torque current, wherein the laundry amount determining unit compensates a result of determination of laundry amount, based on the unbalanced state detected by the unbalance detector.

* * * * *